United States Patent [19]

McQueary

[11] 4,012,540

[45] * Mar. 15, 1977

[54] METHOD OF CONDITIONING FABRICS IN A CLOTHES DRYER

[75] Inventor: Agnes R. McQueary, Cincinnati, Ohio

[73] Assignee: The Procter & Gamble Company, Cincinnati, Ohio

[ * ] Notice: The portion of the term of this patent subsequent to Mar. 6, 1993, has been disclaimed.

[22] Filed: Nov. 10, 1975

[21] Appl. No.: 630,381

Related U.S. Application Data

[62] Division of Ser. No. 347,605, April 3, 1973, Pat. No. 3,944,694.

[52] U.S. Cl. ..... 427/242; 427/11

[51] Int. Cl.[2] ..... B05D 3/12

[58] Field of Search ..... 427/242, 11

[56] References Cited

UNITED STATES PATENTS

| | | | |
|---|---|---|---|
| 2,112,963 | 4/1938 | Jones | 15/208 |
| 2,169,415 | 8/1939 | Giese | 427/395 UX |
| 2,665,528 | 1/1954 | Sternfield et al. | 427/395 UX |
| 3,112,219 | 11/1963 | Politzer et al. | 427/244 |
| 3,442,692 | 5/1969 | Gaiser | 427/242 |
| 3,654,060 | 4/1972 | Goldman | 427/2 UX |
| 3,686,025 | 8/1972 | Morton | 427/242 |
| 3,696,034 | 10/1972 | Hewitt et al. | 252/8.8 |

*Primary Examiner*—Harry J. Gwinnell
*Attorney, Agent, or Firm*—Louis G. Xiarhos; Douglas C. Mohl; Richard C. Witte

[57] ABSTRACT

A fabric-conditioning article adapted to the conditioning of fabrics in a laundry dryer comprising a flexible substrate carrying a conditioning agent removable to fabrics by contact therewith in a laundry dryer and having slit openings. The article is adapted to the provision of fabric-conditioning effects without undesirable restriction by the article of the flow of air through the dryer, permitting at least 75% of the normal volume of air flow through said dryer in use.

3 Claims, 5 Drawing Figures

METHOD OF CONDITIONING FABRICS IN A CLOTHES DRYER

This application is a division of application Ser. No. 347,605, filed Apr. 3, 1973, now U.S. Pat. No. 3,944,694, issued Mar. 6, 1976.

BACKGROUND OF THE INVENTION

This invention relates to an article useful in the conditioning of fabrics in a laundry dryer. More particularly, it relates to an improved fabric-conditioning article in the form of a flexible substrate carrying a conditioning agent removable to fabrics in a laundry dryer.

The employment of fabric-conditioning articles to impart softening, antistatic, lubricating, bacteriostatic mildew-proofing or other desirable fabric-conditioning effects in a laundry dryer has been described in the art. For example, U.S. Pat. No. 3,442,692 to Gaiser (May 6, 1969) describes the conditioning of fabrics in a laundry dryer by cotumbling the fabrics with a flexible substrate carrying a conditioning agent. The conditioning agent is removed to the tumbling fabrics to provide a fabric conditioning which otherwise might only inconveniently be effected by treatment, for example, during the rinsing cycle of a laundering operation. Similarly, U.S. Pat. No. 3,686,025, issued Aug. 22, 1972 to Morton, describes an article for conditioning fabrics in a laundry dryer. The article comprises an absorptive substrate impregnated with a fabric-softening agent for the provision of fabric softening effects with minimal staining tendencies.

While the fabric-conditioning articles of the prior art are effective to provide a variety of fabric surface modifications, such as fabric softening, their effectiveness can be diminished where they are not structurally compatible with the various types of automatic laundry dryers available in the marketplace. There maybe a tendency, for example, for such articles to become physically immobilized in certain types of laundry dryers by sticking or otherwise attaching to the exhaust outlet means of the dryer or to a lint filter or trap by the drawing effect of exhausting air and water vapor. The passage of air into the area within which the tumbling clothes are confined and out of the dryer, as by passage through a perforated rear wall or door, creates a drawing effect capable of holding a fabric-conditioning article in such a manner as to impede the flow of air out of the laundry dryer.

The tendency of a fabric-conditioning article to restrict air flow is most noticeable where the article is employed in a fabric load comprised of only a few tumbling fabrics. A load of 2 lbs. dry weight or less is an example of such a load. Normally, restricted air flow will result in slow or inefficient drying. If air blockage is sufficient, dangerous build-up of heat in the dryer can occur and should the temperature in the heater housing exceed a preset limit, for example, 275° F, the high-limit thermostat of the dryer will open and thereby interrupt the flow of current to the heater or gas to the burner. In some models, the high-limit thermostat will also shut off power to the drive motor requiring that the dryer be restarted. The high-limit thermostat is closed in normal operation and any situation calling this devices into operation is desirably avoided.

It is an object of the present invention to provide a fabric-conditioning article compatible with laundry dryers.

It is another object of the present invention to provide a fabric-conditioning article capable of conditioning fabrics in a laundry dryer without adversely affecting air flow.

A further object is to provide an article for conditioning fabrics in a laundry dryer and which prevents undesirable build-up of heat.

Other objects will become apparent from the description appearing hereinafter.

SUMMARY OF THE INVENTION

These and other objects can be achieved by the present invention which resides in a fabric-conditioning article especially adapted to the conditioning of fabrics by tumbling of the fabrics in a laundry dryer and which is structurally compatible with laundry dryers as to minimize air-flow interruption. Summarizing the invention, it comprises a fabric-conditioning article comprising a web substrate carrying a fabric-conditioning agent removable to fabrics by contact therewith in a laundry dryer and having slit openings sufficient in size and number as to reduce restriction by said article of the flow of air through a laundry dryer. In its method aspect, the invention provides, in the conditioning of fabrics by addition of conditioning agents thereto, the step of commingling the fabrics to be conditioned with a substrate carrying a conditioning agent removable to the fabrics and having slit openings to thereby reduce the hindering or restrictive effect of the article upon the exhaust of air from the dryer.

The fabric-conditioning article comprises a flexible web such as paper or cloth carrying a conditioning agent such as a fabric softening agent and is normally made up into a tubular roll of individual sheets. A desired length of the treated web is torn off the roll or a sheet removed from its package and placed into the clothes dryer wherein the fabrics to be treated have been loaded. The dryer is then operated in customary fashion, and fabric conditioning occurs as the fabrics directly contact the treated web, whereby the conditioning agent is transferred from the web substrate to the fabric. Particularly when small fabric loads are tumbled and the probability of a tumbling fabric-conditioning article of making repeated or prolonged contact with a laundry dryer exhaust outlet is enhanced, the slit openings of the treated web advantageously minimize the interruption of air flow through the dryer. This is effected by passage of air through the slit web structure or by crumpling or puckering of the slit web in such a manner as to permit minimal blockage of the air exhaust outlet and/or ready detachment therefrom by collision with tumbling fabrics.

Various objects, details, constructions, operations, uses, advantages and modifications of the invention will be apparent from the following description, taken in conjunction with the illustrative drawing of certain embodiments thereof.

THE DRAWING

DETAILED DESCRIPTION OF THE INVENTION

Figure 1:
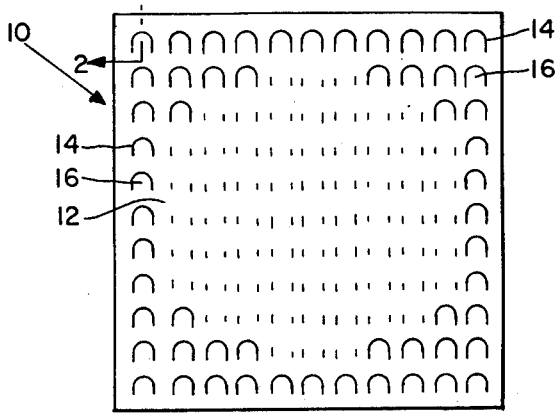
FIG. 1 is a plan view of a fabric-conditioning article of the invention.

In FIG. 1, is shown a conditioning article 10 having a flexible web substrate 12 coated or impregnated with a conditioning agent, not shown, designed to be transferred to tumbling articles of laundry coming into contact therewith. As is illustrated in FIG. 1, the conditioning article 10 contains a plurality of curvilinear slits 14 in the form of an inverted U-shape. When the article is commingled with fabrics in a laundry dryer and is caused to be drawn by the changing volumes of circulating air onto the air exhaust outlet of a conventional laundry dryer, the effect of the drawing air or gas is to open the individual gate-like or flap structures 16 so as to permit the passage of air therethrough. As the article 10 is placed into a form-retaining relationship to a perforated door or wall exhaust outlet, the gate-like structures 16 permit sufficient passage of air as to release the vacuum or drawing effect of the circulating air and cause the article to fall into the tumbling fabrics with the result that contact between the article and the exhaust outlet is minimized and contact between the article and the tumbling fabrics is maximized.

Figure 2:
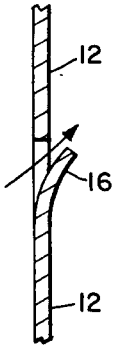
FIG. 2 is an enlarged fragmentary sectional view of the article of FIG. 1 in use.

In FIG. 2 is shown as enlarged fragmentary sectional view of the fabric-conditioning article 10 of FIG. 1. The flexible web substrate 12 carrying the conditioning agent has a gate-like or flap structure 16 shown in an open position which permits passage of air therethrough.

Figure 3:
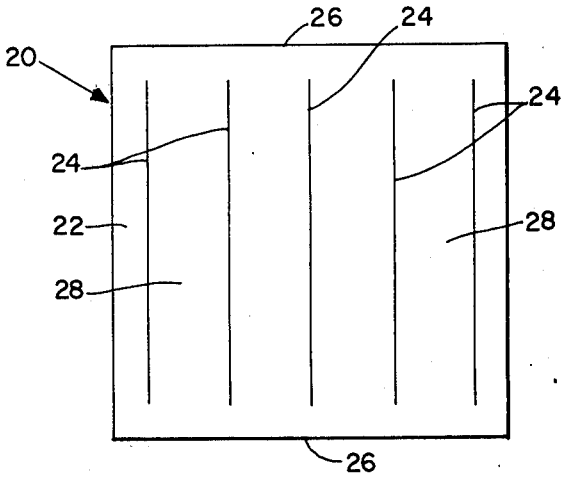
FIG. 3 is a plan view of another embodiment of the invention.

In FIG. 3 is shown a plan view of a fabric-conditioning article 20 comprising a flexible web substrate 22 carrying a fabric conditioning agent and having a plurality of rectilinear slits 24 extending along one dimension of the web substrate 22 and being placed a finite distance from the ends 26. The slits define a plurality of sections 28.

Figure 4:
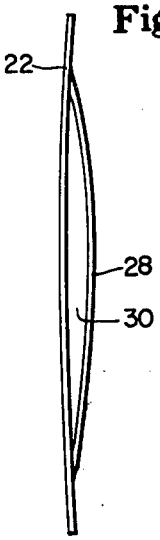
FIG. 4 is a side view of the article of FIG. 3 in a flexed position.

In FIG. 4 is shown a side view of the conditioning article of FIG. 3. As illustrated, flexing of the substrate 22 and section 28 provides an air space 30 through which circulating air can pass. The article, if drawn to the exhaust outlet of a laundry dryer, is drawn in a flexed or crumpled form, leaving at least a portion of the exhaust outlet uncovered by the article and thereby permitting passage of air through the outlet. The puckering or crumpling of the article allows tumbling fabrics to make contact with and remove the article from the exhaust outlet thereby effecting retumbling of the fabrics and fabric-conditioning article.

Figure 5:
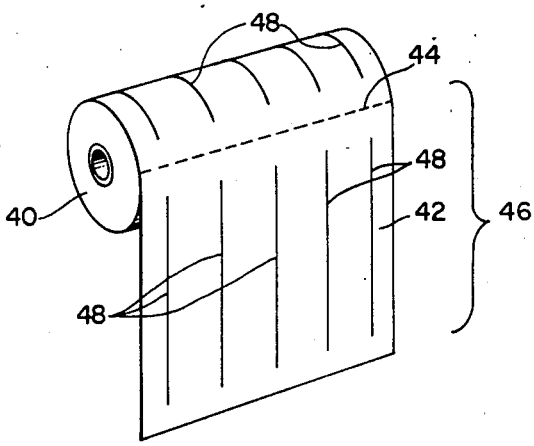
FIG. 5 is an isometric view of a preforated roll of fabric-conditioning article from which individual sheets can be detached for use in the method hereof.

In FIG. 5 is shown a roll 40 of wound web 42 having spaced lines of weakness 44, in the form of perforations, detachably connecting sections 46 which provide sheets having a coating or impregnation of the conditioning agent, each sheet being of a size carrying the same predetermined amount of agent suitable for use in treating a usual load of clothes in a conventional household laundry dryer. As illustrated, rectilinear slits 48 are shown extending a finite distance from the perforated lines of weakness.

The fabric conditioning articles of the invention comprise a flexible web substrate carrying a conditioning agent. Suitable substrate materials for carrying the conditioning agent include a variety of natural or synthetic substrate materials. Suitable substrates are those which have the ability to retain a fabric-conditioning agent in a form which is releasable to fabrics tumbled therewith and which have a resistance to shredding or other tearing failures when tumbled with damp clothes in a dryer. Examples of suitable substrates include paper towelling, swatches of woven and non-woven cloth, papers, sponges, plastics and felts. Fibrous materials can be natural or synthetic but are preferably cellulosic. Foam plastic web materials, such as the polyurethanes, can also be employed.

In one embodiment of the invention, a substrate which is relatively impermeable to the fabric-conditioning agent is employed so as to dispose the fabric-conditioning agent onto the substrate as a discrete surface coating. Wet strength papers, regenerated cellulose, rayon, nylon, polyester, polyacrylonitrile, polyolefin and other synthetic woven or non-woven fibrous material are suitable for this purpose. Wet strength paper is suitably employed and can be treated with a waterproofing or sizing material such as a thermosetting resin, starch or other impregnant, having the effect of reducing water absorption by fibrous cellulosic products and allowing the formation of a coating of conditioning agent. Waxy papers which carry coatings or impregnations of paraffin or microcrystalline or synthetic wax can be used, e.g., "butcher paper" or dry waxed paper, to the extent of reducing moisture absorption but permitting adherent coating of the paper with conditioning agent. Wet strength papers, such as Kraft or bond paper, can be suitably employed.

Preferred articles of the invention include those formed from a substrate having an absorption capacity in relation, for example, to fabric softening agents as to provide an impregnated article capable of controllably releasing the softening agent to treated fabrics. Improved softness or feel of the treated fabrics is provided without overdosing or localized concentration of softener in the form of spots or stains. Suitable absorbent substrate materials are described in considerable detail in U.S. Pat. No. 3,686,025, issued Aug. 22, 1972 to Morton. Preferred absorbent substrates are cellulosic materials such as multi-ply paper towel and non-woven cloth substrates. Preferred paper towel materials and their method of manufacture can be found in U.S. Pat. No. 3,414,459, issued Dec. 3, 1968 to Wells, and incorporated herein by reference. Preferred non-woven cloth substrates can be generally defined as adhesively-bonded fibrous or filamentous products having a web structure, in which the fibers or filaments are distributed haphazardly, as in the "wet bag" process, or with a degree of orientation, as in the "carding" process. Such substrates exhibit desirable strength in all directions and are resistant to shredding or tearing failures when tumbled with damp fabrics. The fibers or filaments of such non-woven cloth substrates can be natural (e.g., wool, silk, jute, hemp, cotton, linen, sisal or ramie) or synthetic (e.g., rayon, cellulose ester, polyvinyl derivatives, polyolefins, polyamides or polyesters) and are bonded together with a polymeric binder resin such as polyvinyl acetate. Such substrates will normally have void volume of from about 40% to about 90%, to provide desirable absorbent properties.

The conditioning agents employed herein include any of a variety of agents employed generally in textile treating operations. Accordingly, fabric softening, antistatic, anti-mildew, germicidal, mothproofing and anti-wrinkling agents, perfumes and the like can be employed. The most universal preference, however, is for agents which act to soften fabrics or otherwise improve their feel or hand. Softening agents which also have antistatic properties and which reduce static charge or fabric cling are especially preferred.

Typically, the fabric softening agents that can be employed are compounds having a relatively-long hydrocarbon group serving to provide hydrophobicity or lubricity. Among such groups are alkyl groups containing 8 or more carbon atoms and preferably from 12 to 22 carbon atoms. Suitable fabric softening agents include cationic, anionic, nonionic, or zwitterionic compounds. Cationic fabric-softening agents include the cationic nitrogen-containing compounds such as quaternary ammonium compounds and amines which have one or two straight-chain organic groups of at least eight carbon atoms. Preferably, they have one or two such groups of from 12 to 22 carbon atoms. Preferred cation-active softener compounds include the quaternary ammonium softener compounds corresponding to the formula

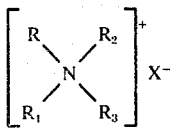

wherein R is hydrogen or an aliphatic group of from 12 to 22 carbons; $R_1$ is an aliphatic group having from 12 to 22 carbon atoms; $R_2$ and $R_3$ are each alkyl groups from 1 to 3 carbon atoms; and X is an anion selected from halogen, acetate phosphate, nitrite and methyl sulfate radicals.

Because of their excellent softening efficacy and ready availability, preferred cationic softener compounds of the invention are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein R and $R_1$ have predominantly from 16 to 18 carbon atoms. The term "coconut" refers to fatty acid groups from coconut oil fatty acids. The coconut-alkyl R and $R_1$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride, dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl diethyl ammonium chloride; dihexadecyl dimethyl ammonium acetate; ditallow dipropyl ammonium phosphate; ditallow dimethyl ammonium nitrite; di(coconut-alkyl) dimethyl ammonium chloride.

Suitable cation-active amine softener compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenerated-tallow amine; tallow 1,3-propylene diamine; oleyl 1,3-propylene diamine; coconut 1,3-propylene diamine; soya 1,3-propylene diamine and the like.

Other suitable cation-active softener compounds herein are the quaternary imidazolinium salts. Preferred salts are those conforming to the formula

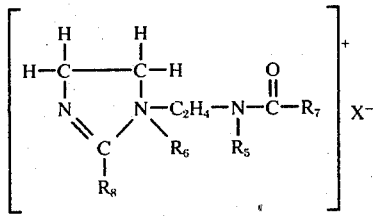

wherein $R_6$ is an alkyl containing from 1 to 4, preferably from 1 to 2, carbon atoms, $R_7$ is an alkyl containing from 1 to 4 carbon atoms or a hydrogen radical, $R_8$ is an alkyl containing from 8 to 22, preferably at least 15, carbon atoms, $R_5$ is hydrogen or an alykl containing from 8 to 22, preferably at least 15, carbon atoms, and X is an anion, preferably methyl sulfate or chloride ions. Other suitable anions include those disclosed with reference to the cationic quaternary ammonium fabric softeners described hereinbefore. Particularly preferred are those imidazolinium compounds in which both $R_5$ and $R_8$ are alkyls of from 12 to 22 carbon atoms, e.g., 2-heptadecyl-1,1-methyl [(2-stearoylamido)ethyl] imidazolinium methyl sulfate.

Other cationic quaternary ammonium fabric softeners, which are useful herein include, for example alkyl ($C_{12}$ to $C_{22}$)-pyridinium chlorides, alkyl ($C_{12}$ to $C_{22}$)-alkyl ($C_1$ to $C_3$)-morpholinium chlorides, and quaternary derivatives of amino acids and amino esters.

The anionic conditioning agents can include any of the various surface-active anionic fabric-softening and antistatic agents such as alkali metal or ammonium salts of higher fatty alcohol sulfates, higher fatty alcohol ether sulfates, higher fatty alcohol sulfonates, the linear higher alkyl benezene sulfonates, the higher fatty acyl taurides and isethionates. Generally, the cation of such compounds will be an alkali metal or other water-solubilizing radical. The hydrophobic moiety of such compounds will normally contain from 10 to 22 carbon atoms. Alkali metal and ammonium soaps of fatty acids of from 10 to 22 carbon atoms can also be employed and include the sodium or potassium coconut or tallow soaps.

Suitable nonionic fabric softeners and antistatic agents that can be employed are the polyoxyalkylene glycols, the higher fatty alcohol esters of polyoxyalkylene glycols, the higher fatty alcohol esters of polyoxyalkylene glycols. Also suitable are the ethoxylates of long-chain alcohols of from 8 to 22 carbon atoms such as the ethoxylates of tallow alcohol with, for example, 10 to 40 moles of ethylene oxide. Other nonionics include the amides such as the alkanolamides, e.g., the higher fatty amides and higher fatty acid monoand di-lower alkanolamides, wherein the long-chain hydrophobic groups have from about 10 to 22 carbon atoms.

Other suitable softening agents include the zwitterionic compounds of the formula

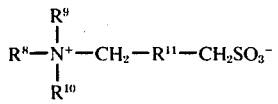

wherein $R_9$ and $R_{10}$ are each methyl, ethyl, n-propyl, isopropyl, 2-hydroxyethyl or 2-hydroxypropyl, $R_8$ is a 12 to 22 carbon atom alkyl or alkenyl and wherein said alkyl or alkenyl contains from 0 to 2 hydroxyl substituents, from 0 to 5 ether linkages, and from 0 to 1 amide linkage, and $R_{11}$ is an alkylene group containing from 1 to 4 carbon atoms with from 0 to 1 hydroxyl substituents; particularly preferred are compounds wherein $R_8$ is a carbon chain containing from 14 to 18 carbon atoms selected from the group consisting of alkyls and alkenyls and wherein said alkyls and alkenyls contain 0 to 2 hydroxy substituents. Specific examples of the particularly preferred compounds of this class include the following: 3-(N-hexadecyl-N,N-dimethylammonio)-2-hydroxypropane-1-sulfonate; and 3-(N-octadecyl-N,N-dimethylammonio)-propane-1-sulfonate.

Other examples of conditioning agents suitable for the articles herein are described in detail in U.S. Pat. No. 3,686,025 at column 5, line 51 to column 14, line 6, which disclosure is incorporated herein by reference.

The amount of conditioning agent carried by the substrate is an amount sufficient to provide the desired conditioning effect without substantial excess. The amount will vary in any given case and will depend, for example, upon the nature of the particular conditioning agent or substrate material and the type of conditioning effect desired. When the conditioning agent is a fabric softening agent, such agent will preferably be employed in a weight ratio of agent to untreated substrate of from 1:1 to 4:1 or more. Generally, the amount of softener will range from about 2 grams to about 37 grams per foot length of a substrate no more than 11 inches wide, with small amounts of softener being used on lightweight substrates, such as non-woven cloths, and large amounts on heavy substrates, such as multi-ply paper.

The fabric-conditioning articles of the invention can be prepared by employing a number of coating or impregnating techniques known in the art. The relationship between conditioning agent and web substrate is a physical one and for this reason one method will be more suited than another and will depend upon the type of article desired or the nature of conditioning agent or substrate employed. Suitable articles can be prepared, for example, by padding techniques whereby a web is passed through a solution or dispersion of conditioning agent, the excess is removed and the article is allowed to dry. Similarly, the conditioning agent can be sprayed in known manner to provide a similar article. Hot-melt application of a normally-solid fabric softener, for example, can be employed to provide a waxy coated article suited for softening tumbling fabrics. The precise method by which a conditioning article of the invention is prepared should not, however, be considered as limiting the present invention which is directed to certain structural modifications of such conditioning articles to provide laundry dryer compatibility. Examples of fabric conditioning articles suited for such modification and of methods of preparing them are provided in considerable detail in U.S. Pat. Nos. 3,442,692, 3,632,396 and 3,686,025, incorporated herein by reference.

The fabric conditioning articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying gas in the dryer drum per minute and the air moves at about 125 to 175 cubic feet per minute. These changing volumes of air create a drawing or suction effect which can, especially in small loads, cause a fabric, such as a sock, handkerchief or the like, or a fabric-conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric conditioning article is caused to be disposed in relation to the air exhaust outlet in such a manner as to permit blockage of passing air, undesirable temperature increases can result. This can occur in the case of the employment of fabric-softening articles prepared from normally-solid or waxy softener agents which soften or melt under conditions of heat and which, therefore, may tend to adhere to an exhaust outlet.

The slit openings are provided in the fabric-conditioning articles of the invention for two principal purposes. Importantly, the slits permit passage of air in the event the article is placed in a blocking relationship to the air exhaust outlet. Moreover, the slit openings provide a degree of flexibility or resiliency causing the article to crumple or pucker. The effect of such crumpling is that only a portion of the air exhaust outlet will be covered by the conditioning article in the event it is carried by the moving air stream to the exhaust outlet. Moreover, the crumpled article is more readily removed by tumbling fabrics than would be the case if the article were placed in a flat relationship to the exhaust outlet.

The type and number of slit openings can vary considerably and will depend upon the nature of the substrate material, its inherent flexibility or rigidity, the nature of the conditioning agent carried therein or thereon, and the extent to which increased passage of air therethrough is desired. The articles of the invention can comprise a large number of small slits of various type or configuration or fewer larger slits. For example, a single rectilinear or wavy slit, or a plurality thereof, confined to within the area of a sheet and extending close to opposite edges of the article, can be employed. By maintaining a border around all edges of the conditioning article, a desired degree of flexibility and surfaces area availability to tumbling fabrics can be maintained. While, for example, rectilinear slits can be cut into a conditioning article completely to the edges of the article, confinement of the slits to within the area of the article will be preferred where the convenience of a roll form of conditioning article is desired.

According to a preferred embodiment of the invention, a sheet of fabric-conditioning article is provided with a plurality of rectilinear slits extending in one direction, e.g., the machine direction of the web substrate, and in a substantially parallel relationship. The slits can be aligned or in a staggered relationship. A preferred embodiment will contain from 5 to 9 of such slits which will extend to within about 2 inches and preferably 1 inch from the edge of the web material which is, for example, a 9 inches × 11 inches sheet. In general, the greater the number and the longer the slits, the greater the effect in preventing restriction of air flow. Such an article permits the individual panel areas or sections within the rectilinear slits to flex or move in independent relationship to each other and out of the plane of the sheet. This flexing minimizes the probability that such an article will align itself in a flat and blocking relationship to an exhaust outlet. The inherent puckering or crumpling tendency of the article allows the article to convert the air outlet in such a manner as to leave at least a portion of the air exhaust outlet uncovered. In addition, the tumbling fabrics in the dryer will collide with the crumpled article causing it to be removed from the exhaust outlet. Its removal is readily accomplished by reason of the protrusion of the crumpled article which makes it more available for contact with the tumbling load of fabrics in the dryer.

The slit openings in the conditioning articles of the invention can be in a variety of configurations and sizes as can be readily appreciated. In some instances, it may be desirable to provide slit openings as C-, U- or V-shaped slits. Such slits arranged in a continuous or regular or irregular pattern are desirable from the standpoint of permitting gate-like or flap structures which permit the passage of air therethrough.

In accordance with a preferred embodiment of the invention, a plurality of curvilinear slit openings, such as U-shaped, or C-shaped slits are provided in a continuously patterned arrangement. These slit arrangements provide flap-like or gate-like structures which should approximate the size of the perforations normally employed in laundry dryer exhaust outlets. A width dimension of from about 0.02 to about 0.40 inch is preferred. U- or C-shaped slits, e.g., about ⅛ inch in diameter, are desirably provided in close proximity to each other, e.g., about ⅛ inch apart, as to simulate, for example, a fish-scale pattern. Such design in addition to permitting passage of air, provides a degree of flexibility to the substrate as to allow flexing or puckering of the article in use. Similarly, the slit openings can be arranged as spaced rows of slits or as a plurality of geometrical patterns. For example, an article of the invention can comprise a plurality of squares, circles, triangles or the like, each of which is comprised of a plurality of individual slits. Other embodiments include small or large S-shaped slits, X-slits or crosses; slits conforming to alphabetical or numerical patterns, logograms, marks, floral and other designs can also be employed.

It will be appreciated that the passage of air through an article of the invention will depend upon the number and size of the slit openings. The number and size of slits desirably employed can be determined on the basis of trial and error. Obviously, only a few small slits will not likely permit a substantial increase in the amount of air capable of passing through the article. Accordingly, the number of slits will be determined by the extent to which such increase of air passage is desired. Preferably, a fabric conditioning article of the invention will contain a sufficient number of slit openings as to permit the passage of at least about 75% of the normal volume of air flow of the laundry dryer. This permits fabrics to be dried efficiently without undesirable temperature build-up or alternate on/off cycling of the heater and resulting rise and fall of dryer temperature. Normal operating temperatures are adhered to and extended drying times are thereby avoided. Preferably, an article will have a sufficient number of slit openings as to allow at least 85% of the volume of air to pass through the dryer.

The fabric conditioning articles of the invention are simple to employ and normally will be employed in a laundry dryer which is operated at a temperature, for example, of from 75° F to 210° F and for a drying period of from about 5 to 45 minutes. A load of fabrics to be dried is placed into the dryer and a sheet, such as may be detached by tearing from a perforated roll, is simply added to the dryer which is operated in usual fashion. The treated fabrics are then removed and handled in customary fashion.

The following Examples illustrate certain preferred embodiments of the invention and are not intended as limiting the invention. The quaternary ammonium fabric softening agent of Examples I – IV was di tallow dimethyl ammonium chloride. Other of the various fabric conditioning agents described hereinbefore in detail can be employed to advantage.

EXAMPLE I

Sheets of non-woven cloth substrate (9 inches × 11 inches) carrying a quaternary ammonium fabric-softening agent were provided, respectively, with one, three, five, seven and nine slit(s) of 7 inch length as follows. One sheet contained a rectilinear slit of seven-inch length along the machine direction of the substrate and placed in the center of the sheet (4.5 inches from either edge). The 7 inch slit with a 2 inch margin at each end comprised the 11 inch dimension. The multiple and parallel slit variations, all slits being 7 inches in length, were prepared by confining the slits, cut in the machine direction, to within a bordered area. A 2 inch margin was provided by allowing 2 inches at each end of each slit. Similarly, a 1.5-inch margin was provided along the 11-inch dimension by placing a slit 1.5 inches from each edge and equidistantly spacing the remaining slits. In so doing, the slits were spaced on the 9 inch × 11 inch sheet within an area of 6 inches × 7 inches.

Each article of the invention was evaluated for its potential to minimize interference with dryer air flow by observing its tendency to stick or otherwise adhere to the exhaust outlet of a laundry dryer by tumbling the article in a fabric load purposely designed to maximize the probability of a tumbling article being drawn to an exhaust outlet. Each load, of 0.6 lb. dry weight, was comprised of two pillowcases and the fabric-conditioning article. The laundry dryer, a "Kenmore 800" automatic, electric home clothes dryer, was operated in a conventional manner for a 15-minute cycle. Each fabric-conditioning article was tumbled with the pillowcases and was observed for its tendency to become attached to the perforated real-wall exhaust outlet. The number of times that the article adhered to the outlet for a 20-second duration was recorded. A control article having no slits was evaluated in the same manner for purposes of comparison. The following results were obtained, duplicate numbers representing separate evaluation of replicate samples:

| Article | No. of 20-second contacts |
|---|---|
| Control (no slits) | 15 |
| one seven-inch slit | 2,3 |
| three seven-inch slits | 2,3,3,5 |
| five seven-inch slits | 1,3,2,4 |
| seven seven-inch slits | 1,0,3,2 |
| nine seven-inch slits | 1,0 |

EXAMPLE II

A sheet of non-woven cloth (9 inches × 11 inches) carrying a quaternary ammonium fabric-softening agent was provided with five parallel 5-inch slits, the slits being cut into the machine direction. The outer slits were placed 1.5 inches inwardly from the 11-inch side. The three additional five-inch slits were placed equidistantly within the encompassed area. The 5-inch slits were placed such that, in alternating pattern, the slits had a 2-inch margin at one end and a 4-inch margin at the other, i.e., the 11-inch dimension comprised a 2-inch margin, a 5-inch slit and a 4-inch margin. The two outermost and the center 5-inch slits extended to within 2 inches from one edge of the substrate while the two remaining 5-inch slits extended to within two inches of the opposite edge.

EXAMPLE III

A sheet of non-woven cloth (9 inches × 11 inches) carrying a quaternary ammonium fabric-softening agent was provided with seven parallel five-inch slits in the same manner as in the article of EXAMPLE II. Four of five-inch parallel slits, including the two outermost slits, extended to within two inches from one edge and four inches from the opposite edge. The remaining three five-inch slits extended to within two inches from one edge and four inches from the other.

The articles of EXAMPLES II and III were evaluated in the same manner as that of EXAMPLE I with the following results:

| Article | No. of 20-second contacts |
|---|---|
| EXAMPLE II | 2,6 |
| EXAMPLE III | 1,0 |

EXAMPLE IV

A 9 inch × 11 inch non-woven cloth substrate carrying a quaternary ammonium fabric-softening agent was provided with a plurality of C-shaped slits in the following manner. A cutting die providing a C-shaped slit of approximately 0.12 inch in its longest dimension was employed to provide a plurality of slits in a similated fish-scale design. The slits were cut in such a manner as to completely cover the area of the substrate, the distance between adjacent slits being approximately 0.1 inch. The number of C-shaped slits comprised an average of approximately 15 per square inch. The article was evaluated as described previously with the result that there were no contacts of 20-second duration in the 15-minute drying cycle.

What is claimed is:

1. The method of conditioning fabrics in a laundry dryer which comprises commingling said fabrics in said dryer with a fabric-conditioning article comprising a flexible web substrate carrying a fabric-conditioning agent removable to fabrics by contact therewith, said fabric-conditioning article having slit openings sufficient in size and number as to permit at least 75% of the normal volume of air flow through said dryer when said article is used therein.

2. The method of claim 1 wherein the slit openings comprise from 5 to 9 substantially parallel and substantially equidistantly placed slits extending along one dimension.

3. The method of claim 1 wherein the slit openings comprise a continuously-patterned arrangement of U-shaped or C-shaped slits.

* * * * *

UNITED STATES PATENT OFFICE

CERTIFICATE OF CORRECTION

PATENT NO. : 4,012,540

DATED : March 15, 1977

INVENTOR(S) : Agnes R. McQueary

It is certified that error appears in the above-identified patent and that said Letters Patent are hereby corrected as shown below:

On the title page at [*] after "to" delete "Mar. 6, 1993" and put in its place -- Mar. 16, 1993 --.

Column 1, line 5, "Mar. 6" should be -- Mar. 16 --.

Column 3, line 27, "as" should be -- an --.

Column 4, line 59, after "have" insert -- a --.

Column 6, line 57, "esters" should be -- ethers --.

Column 8, line 59, "surfaces" should be -- surface --.

Column 9, line 16, "convert" should be -- contact --.

Signed and Sealed this

Twenty-first Day of June 1977

[SEAL]

*Attest:*

RUTH C. MASON
*Attesting Officer*

C. MARSHALL DANN
*Commissioner of Patents and Trademarks*